US005216430A

United States Patent [19]

Rahm et al.

[11] Patent Number: 5,216,430

[45] Date of Patent: Jun. 1, 1993

[54] LOW IMPEDANCE PRINTED CIRCUIT RADIATING ELEMENT

[75] Inventors: James K. Rahm, Bethlehem; Robert H. Frankievich, Doylestown; John D. Martinko, Malvern, all of Pa.

[73] Assignee: General Electric Company, East Windsor, N.J.

[21] Appl. No.: 634,654

[22] Filed: Dec. 27, 1990

[51] Int. Cl.[5] ..... H01Q 1/38

[52] U.S. Cl. ..... 343/700 MS; 343/846

[58] Field of Search ..... 343/700 MS, 846, 829, 343/850, 853, 857, 858

[56] References Cited

U.S. PATENT DOCUMENTS

| | | | |
|---|---|---|---|
| 3,713,162 | 1/1973 | Munson et al. | 343/705 |
| 3,810,183 | 5/1974 | Krutsinger et al. | 343/708 |
| 3,921,177 | 11/1975 | Munson | 343/846 |
| 4,083,046 | 4/1978 | Kaloi | 343/700 MS |
| 4,125,837 | 11/1978 | Kaloi | 343/700 MS |
| 4,125,838 | 11/1978 | Kaloi | 343/700 MS |
| 4,125,839 | 11/1978 | Kaloi | 343/700 MS |
| 4,291,311 | 9/1981 | Kaloi | 343/700 MS |
| 4,291,312 | 9/1981 | Kaloi | 343/700 MS |
| 4,356,492 | 10/1982 | Kaloi | 343/700 MS |
| 4,706,050 | 11/1987 | Andrews | 333/205 |
| 4,873,529 | 10/1989 | Gibson | 343/700 MS |
| 4,876,552 | 10/1989 | Zakman | 343/702 |
| 4,893,126 | 1/1990 | Evans | 343/700 MS |
| 4,903,033 | 2/1990 | Tsao et al. | 343/700 MS |
| 4,929,959 | 5/1990 | Sorbello et al. | 343/700 MS |

FOREIGN PATENT DOCUMENTS

| | | | |
|---|---|---|---|
| 0289085 | 11/1988 | European Pat. Off. . | |
| 0160104 | 12/1981 | Japan | 343/700 MS |
| 0141007 | 8/1983 | Japan | 343/700 MS |
| 0181706 | 10/1984 | Japan | 343/700 MS |
| 2108327 | 5/1983 | United Kingdom . | |

OTHER PUBLICATIONS

"Conformal Active Aperture Array Tested," *Aviation Week & Space Technology*, Jul. 9, 1990, p. 48.

*Primary Examiner*—Rolf Hille
*Assistant Examiner*—Hoanganh Le
*Attorney, Agent, or Firm*—Clement A. Berard, Jr.

[57] ABSTRACT

A printed circuit radiating element comprises a geometrically symmetric planar area of a conducting material separated from a ground plane by a dielectric medium. The driving point of the radiating element is at the base of a notch in one side thereof so that the driving impedance is reduced from that obtained when the element is driven at its edge. Symmetrically disposed on opposite sides of an axis of symmetry of the element along which the driving point lies are two notches which restore the electrical symmetry of the radiating element thereby to suppress higher order modes. The suppression of these higher order modes results in a radiation pattern with minimal cross-polarized energy in the principal planes and high port-to-port isolation which could not be achieved with an asymmetrical element. Two driving points may be employed with the radiating element to produce a dual linearly polarized antenna and a reactive combiner or hybrid may be employed to obtain circularly-polarized radiations. The shape of the radiating element may be square, rectangular or circular, for example, in accordance with the desired characteristics. A plurality of radiating elements may be interconnected via appropriate transmission paths to form an antenna array.

13 Claims, 4 Drawing Sheets

LOW IMPEDANCE PRINTED CIRCUIT RADIATING ELEMENT

The invention described herein was made in the performance of work under NASA Contract No. NAS5-30503 and is subject to the provisions of Section 305 of the National Aeronautics and Space Act of 1958 (42 U.S.C. 2457).

The present invention relates to antennas, and in particular to antennas having a geometrically symmetric shape and being spaced apart from a ground plane.

Conventional microstrip antennas consist of, for example, thin, electrically-conducting, square-shaped radiating elements formed on one surface of a dielectric substrate and having a conductive ground plane on the opposite surface of the substrate. It is conventional to form these antennas using conventional printed circuit techniques and to refer to such antennas as microstrip antennas or microstrip patches or patch antennas. Examples of such antennas are shown in U.S. Pat. No. 4,125,839 issued to Kaloi. FIG. 1*a* of Kaloi shows a square shaped radiating element which is electrically driven (fed) by a radio frequency signal at feed points which are not at the edge of the square patch but are within the patch away from the edge. Because the driving impedance at such feed points is lower than that at the edge, it is therefore more easily matched to the transmission lines driving the antenna. However, driving an antenna of this sort requires coaxial transmission lines wherein the outer conductor is electrically connected to the ground plane and the center conductor passes through a hole in the ground plane and dielectric and is electrically connected (usually soldered) to the conductive antenna patch (e.g. Kaloi FIG. 1*b*).

Microstrip patch antennas are advantageous in that they are relatively flat and smooth and so are adapted for mounting upon the surface of other objects such as missiles, satellites, aircraft or other vehicles. Because they do not protrude from the surface they do not create significant drag or air resistance, neither are they susceptible to being broken or likely to cause injury to personnel as would an antenna that projects away from the surface. The disadvantage of such antenna is that the coaxial transmission lines and the coaxial power combiner/splitters and phase shifters normally used therewith are bulky, heavy, and costly.

That disadvantage can be overcome, in part, by cutting notches in the antenna patch in locations and having depths such that the feed points are located at the bases or bottoms of the notches. For the square microstrip patch antenna of Kaloi this can be accomplished by a pair of rectangular notches, one cut into each of two adjacent edges of the square patch as shown in FIG. 3 thereof, or by two rectangular notches cut on the diagonal from two adjacent corners of the square patch as shown in FIGS. 4 and 5 thereof.

Although the addition of notches to a microstrip patch antenna avoids some of the undesirable aspects of the external mechanical elements required to couple electrical signals to the drive points that are within the periphery of the antenna patch, it introduces undesirable degradation of the electrical performance of the antenna. The notches destroy the symmetry of the patch, thereby introducing non-uniformity into the antenna pattern for radiated or received signals. In the case of a dual linearly-polarized patch or a circularly-polarized patch, the notch for one feed point or port destroys the symmetry required for the other feed point or port. The result of this lack of symmetry is the existence of an undesirable higher order mode in the patch resonator which couples the two driving ports, also causing non-uniformity in the antenna pattern and cross-coupling of signals between the two drive points or ports.

The foregoing and other problems of the prior art microstrip antennas are overcome by the antenna of the present invention which comprises a planar element of conductive material separated from a ground plane by a dielectric medium. The periphery of the element defines a geometrically symmetric shape about at least one axis of symmetry. The element has first and second notches in its periphery that are symmetrically disposed with respect to the axis of symmetry and on opposite sides thereof. Signals are coupled at a location substantial along the axis of symmetry.

In the drawing:

FIG. 1 is a diagram of an antenna including the present invention;

FIGS. 2, 3, and 4 are pictorial representations useful in understanding the operation of the antenna of the present invention;

As is well known in the art, antennas are subject to a reciprocity principle which states that an antenna may be employed as either a transmitting (radiating) antenna or as a receiving antenna with substantially identical performance characteristics. The only difference is that for the former a transmitting device is applying electrical signals to the antenna which are being radiated from the antenna in accordance with its transfer function, as electromagnetic radiation, and in the latter electromagnetic radiation is impinging upon the antenna which converts them in accordance with the same transfer function into electrical signals applied to a receiving device. Accordingly, even though the description herein is generally cast in terms of a transmitting antenna it is understood that the present invention is not limited thereby and is equally applicable to any antenna, transmitting or receiving.

Figure 1:
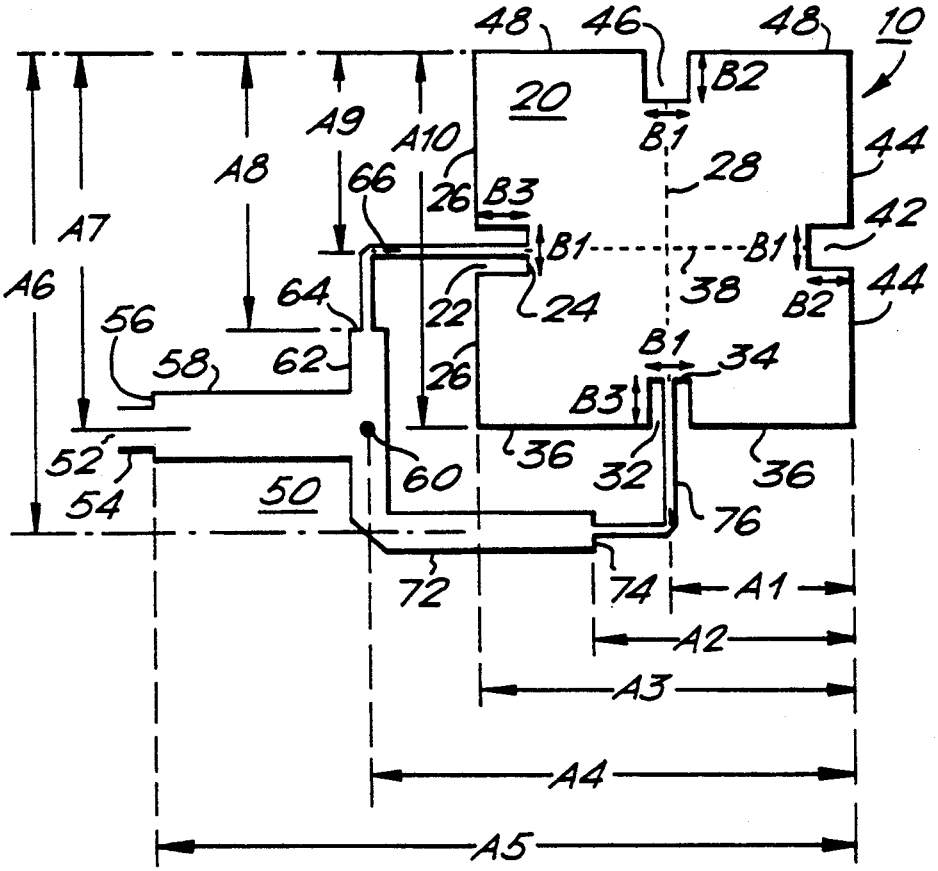

In FIG. 1, antenna 10 includes generally planar radiating element 20 which has a geometrically symmetrical shape and a microstrip feed network 50 through which signals are coupled from node or port 52 to antenna element 20. In particular, the shape of element 20 is rectangular, and more particularly it is a square. The four edges 26, 36, 44, and 48 are the periphery of element 20 and define its shape. A rectangular notch 22 in element 20 extends inwardly from edge 26 at the center thereof, i.e. at a location equidistant from its ends. Similarly, notch 32 extends inwardly from edge 36, notch 42 extends inwardly from edge 44, and notch 46 extends inwardly from edge 48, all said notches also being rectangular.

Because a square is a geometrically symmetric shape, it has at least one axis of symmetry. In fact, it has four axes of symmetry which are its two diagonals and the two bisectors perpendicular to adjacent edges, the latter two of which are shown by dashed lines 28 and 38, the first between notch 32 and notch 46 and the second between notch 22 and notch 42. Rectangular notches 22 and 42 are symmetrically disposed with respect to axis of symmetry 28 and are on opposite sides thereof. Similarly, rectangular notches 32 and 46 are symmetrically located with respect to axis of symmetry 38 and are on opposite sides thereof.

Element 20 has two feed points or ports which are at the base 24 of rectangular notch 22 and at the base 34 of rectangular notch 32, to which ports microstrip conductors 66 and 76 of feed network 50 respectively connect. The length of each edge of element 20 is approximately $\lambda_d/2$ where $\lambda_d$ is the wavelength of the operating frequency signal measured in the dielectric. As used herein, the operating frequency $f_0$ is an identified frequency within the range of frequencies over which the antenna 10 operates. It may be, for example, the center frequency of a band of frequencies, or the carrier frequency of the signal being radiated from or received by antenna 10, or any other frequency within the range of interest.

Feed network 50 employs microstrip techniques that are well known to those skilled in the art although the particular combinations of microstrip features described herein may not be. In such microstrip lines the characteristic impedance of a conductor is inversely related to its line width, with narrower conductors exhibiting higher impedance and wider conductors exhibiting lower impedance. Signals from node 52 are coupled via conductor 54 which is a 50-ohm characteristic impedance transmission line coupled at transition 56 to a reactive power combiner/splitter including conductors 58, 62, and 72. The reactive power combiner provides impedance matching functions via $\lambda/4$ impedance transformation and additionally provides phase shift in proportion to the length of various ones of its conductors. Microstrip conductor 58 is a $\lambda/4$ impedance transformer between transition 56 and point 60, the impedance at transition 56 being 50 ohms as determined by the characteristic impedance of conductor 54 and the impedance at point 60 being 25 ohms as determined by the parallel combination of the 50-ohm characteristic impedance of conductor 62 and the 50-ohm characteristic impedance of conductor 72.

Ideally, for a $\lambda/4$ impedance transformer, the characteristic impedance of the conductor is a function of the impedance at its input and the impedance at its output given by the equation:

$$Z_0 = \sqrt{Z_{in} \times Z_{out}}\,. \tag{1}$$

For the $\lambda/4$ impedance transformer of conductor 58 this is:

$$Z_0 = \sqrt{Z_{56} \times Z_{60}} = \sqrt{50\Omega \times 25\Omega} = 35.7\Omega. \tag{2}$$

The effective electrical length of conductor 72 between point 60 and transition 74 is longer than that of conductor 62 between point 60 and transition 64 by an amount $\lambda/4$ at $f_0$ so that the phase of the signal at transition 74 will lag that of the signal at transition 64 by 90 degrees.

Conductor 66 is an impedance transformer between the 50-ohm impedance at transition 64 and the impedance $Z_d$ at the feed port of element 20 at the center of the base 24 of rectangular notch 22. Similarly, conductor 76 is an impedance transformer between the 50-ohm impedance at transition 74 and the impedance $Z_d$ at the drive point at the center of the base 34 of notch 32.

Applicants have found that the theoretical dimensions of the antenna patch must be adjusted to account for the practical effects present in a physical antenna. The length of each edge of the square was found to be about $0.48 \times \lambda_d$ (rather than the nominal $\lambda_d/2$ length). This slightly different physical length of the edge is believed arise from the combination of a reduction in the effective length owing to the area of the rectangular notch as well as an increase of the effective length due to the fringing of the electric field in the dielectric substrate along the edges of element 20. The effective electrical length is $\lambda/2$.

In a particular embodiment, antenna 10 included a 0.062 inch thick Duroid TM 5880 polytetrafluoroethylene (PTFE) substrate (commercially available from Rogers Corporation of Chandler, Arizona) with a copper printed circuit antenna pattern on one side and a copper ground plane on the opposite side. Rectangular notch 22 has a width B1 selected so that the empty slots on both sides of conductor 66 have a width that is greater than or equal to one times the width of conductor 66. Notch 32 in the embodiment being described is the same width B1. Notches 22 and 32 have a depth B3 selected to obtain the desired driving impedance $Z_d$ at the base 24 of rectangular notch 22 or the base 34 of rectangular notch 32, as the case may be. Rectangular notches 42 and 46 were selected to have the same width as notches 22 and 32 so as to maintain symmetry with respect to the length of the respective breaks in edges 26, 36, 44, and 48 although that is not a requirement. Notches 42 and 46 have a depth B2 selected to provide the greatest isolation between the signals on conductors 66 and 76.

Figure 2:
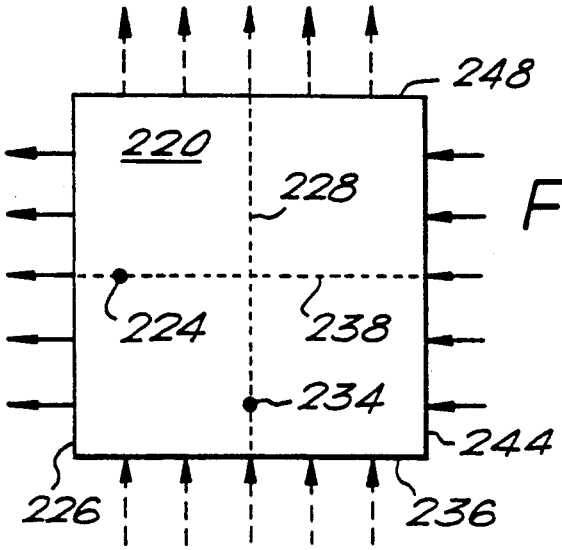
Figure 3:
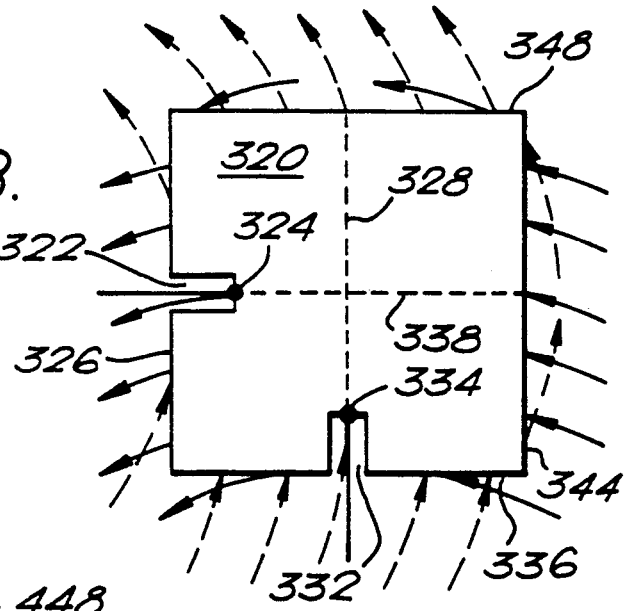

When a square antenna element is driven at its edges, the drive impedance at the feed point is relatively high, for example, about 280 ohms for the size of antenna patch at the frequencies of the application described herein. As the drive point is moved inward toward the center of the patch from the edge, the drive impedance becomes lower. For example, with the depth of notches of the preferred embodiment herein, the drive point impedance is about 230 ohms. In the embodiment of FIGS. 2 and 3 of the Kaloi patent referred to hereinabove, the drive point is at a 50-ohm impedance point. If the drive point were to be moved to the center of the patch, the drive impedance would theoretically be zero ohms. Those of skill in the art select the location of the drive point between the edge and the center of the antenna element so as to obtain a driving impedance that is convenient for design and compatible with the impedances of the transmission line networks conducting signals to or from the antenna element. It was found that once the depth is selected for the notch containing the drive point, the depth of the compensating notch is selected by an empirical process so as to obtain the optimum isolation.

The optimum performance for any particular antenna is best arrived at by an iterative process, it being understood that the degree of isolation practically obtained may be greater if the drive point impedance $Z_d$ of element 20 is larger. For example, with the depth of notches 22 and 32 adjusted to obtain a driving impedance $Z_d$=230 ohms, isolation of 25–30 dB could be obtained, and with the depth of those notches adjusted to obtain $Z_d$=200 ohms, isolation of about 15–20 dB was obtained.

As is known to one of ordinary skill in the art, the dimensions of antennas and microstrip elements are simply scaled in accordance with the operating frequency for which they are intended to be used. In a representative application of antennas including the present invention, having a first antenna intended to transmit at 2.265 GHz and a second to receive at 2.087 GHz, and both being arranged to have a drive point impedance $Z_d$ of about 230 ohms, the following dimensions were employed:

| TRANSMIT ANTENNA ELEMENT | TRANSMIT NOTCH INSETS |
|---|---|
| A1 . . . 0.813 inches | B1 . . . 0.182 inches |
| A2 . . . 1.149 inches | B2 . . . 0.148 inches |
| A3 . . . 1.626 inches | B3 . . . 0.206 inches |
| A4 . . . 2.101 inches | |
| A5 . . . 3.033 inches | |
| A6 . . . 2.101 inches | |
| A7 . . . 1.560 inches | |
| A8 . . . 1.149 inches | |
| A9 . . . 0.813 inches | |
| A10 . . . 1.626 inches | |

| RECEIVE ANTENNA ELEMENT | RECEIVE NOTCH INSETS |
|---|---|
| A1 . . . 0.880 inches | B1 . . . 0.182 inches |
| A2 . . . 1.278 inches | B2 . . . 0.174 inches |
| A3 . . . 1.760 inches | B3 . . . 0.241 inches |
| A4 . . . 2.223 inches | |
| A5 . . . 3.236 inches | |
| A6 . . . 2.223 inches | |
| A7 . . . 1.642 inches | |
| A8 . . . 1.278 inches | |
| A9 . . . 0.880 inches | |
| A10 . . . 1.760 inches | |

Applicants have noticed that the area of the portion of notches 22 and 32 not containing respective conductors 66 and 76 are almost the same as the areas of notches 42 and 46. For example, for the 2.265 GHz transmit antenna element, the area of notches 22 and 34 are about 0.0272 square inches and that of notches 42 and 46 are about 0.0269 square inches. Similarly, for the 2.087 GHz receive antenna element, the area of notches 22 and 34 is about 0.0318 square inches and that of notches 42 and 46 is about 0.03167 square inches.

One particular advantage of the antenna 10 described above is that the combination of notches at the drive points (each of which is located on an axis of symmetry) with additional notches symmetrically disposed therewith with respect to the axis of symmetry of the antenna element 20 is that it permits use of a reactive power combiner/splitter which can be fabricated in microstrip as described above. This avoids the need for a quadrature hybrid power divider and associated load, thereby saving significant volume, weight and expense. This is of particular importance when a plurality of antenna elements 20 are used in an array in which the required spacing of elements does not permit such hybrid power dividers to be employed. It also eliminates the need for a multilayer feed network board which may be required where such hybrid power dividers are used, thereby achieving a further savings in weight, cost and complexity.

It is noted that there are no holes or slots within the antenna element 20 which could cause a redistribution of the antenna electric fields or internal current flow thereby to distort the antenna radiation pattern or which would preclude the use of the antenna in transmitting or receiving circularly polarized signals.

Figure 4:
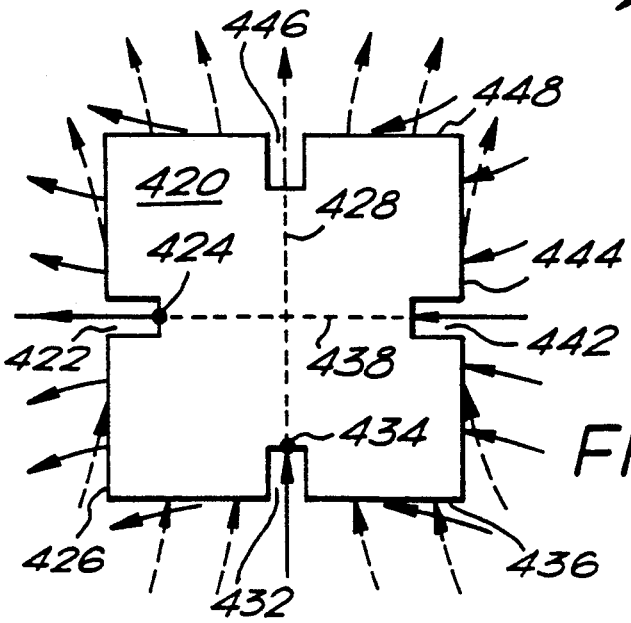

FIGS. 2, 3, and 4 show pictorial representations of antenna elements which are helpful in understanding the operation of the present invention in a qualitative manner, without theoretical or mathematical rigor. In FIGS. 2, 3, and 4, which illustrate an electric field radiation conception of the operation of the present invention, the three digit designators generally correspond to each other and to those of FIG. 1 in that the last two digits for any feature designator generally correspond among that feature in all of the figures, whereas the first digit (the 2, 3, or 4) corresponds to the figure number. Thus, antenna element 20 of FIG. 1 corresponds to the elements 220 in FIG. 2, elements 320 in FIG. 3, and so on. The electric field lines are represented by the short arrows emanating from the edges of the antenna element 220, 320, or 420, as the case may be. The solid-line arrows represent fields related to the signal at drive points 224, 324 and 424 and the dashed-line arrows representing those related to drive points 234, 334 and 434.

In FIG. 2, antenna element 220 is driven at feed points 224 and 234 by signals in quadrature thereby to operate as a circularly-polarized antenna. There is a symmetric radiation pattern around the periphery of element 220 (which is itself symmetrical) as symmetry is represented by the five arrows of approximately the same length emanating from each of the four edges 226, 236, 244, and 248. Not only does antenna element 220 have a radiation pattern with two principal planes of symmetry without cross-polarization, but it also exhibits very high port-to-port isolation (theoretically infinite, but practically approximately 25 dB to 30 dB) between feed points 224 and 234 as a result. The two planes of symmetry are perpendicular to each other and to the plane of element 220 intersecting therewith at axes of symmetry 228 and 238. The E-field is spatially symmetric in both amplitude and phase with respect to each of these principal planes.

In FIG. 3, notches 322 and 332 in antenna element 320 have drive points 324 and 334 at their respective bases. The effect of these notches is to introduce an asymmetry in the shape of antenna element 320 which, in turn, results in an asymmetry in the radiation therefrom. Note that it is notch 332 that introduces asymmetry with respect to drive port 324 and notch 322 that introduces asymmetry with respect to drive port 334. This is shown in representative fashion with respect to drive port 324 by the curvature in one direction of arrows emanating from each of edges 326 and 344, as well as those emanating from edges 366 and 348. This asymmetry in antenna element 320 not only distorts the antenna radiation pattern by introducing cross-polarization with respect to the principal planes intersecting element 320 at lines 328 and 338, but also seriously degrades the signal isolation between feed points 324 and 334 from that obtainable in a symmetrical case.

In FIG. 4, the asymmetry introduced by notches 422 and 432 is compensated by the addition of notches 442 and 446 which substantially restore the geometrical symmetry of the shape of antenna element 420. Notches 442 and 446 also restore the symmetry of the radiation, eliminating cross-polarization radiation on the principal planes. In addition to restoring the symmetry of the antenna radiation pattern with respect to both principal planes, isolation between feed points 424 and 434 is likewise substantially increased.

Figure 5:
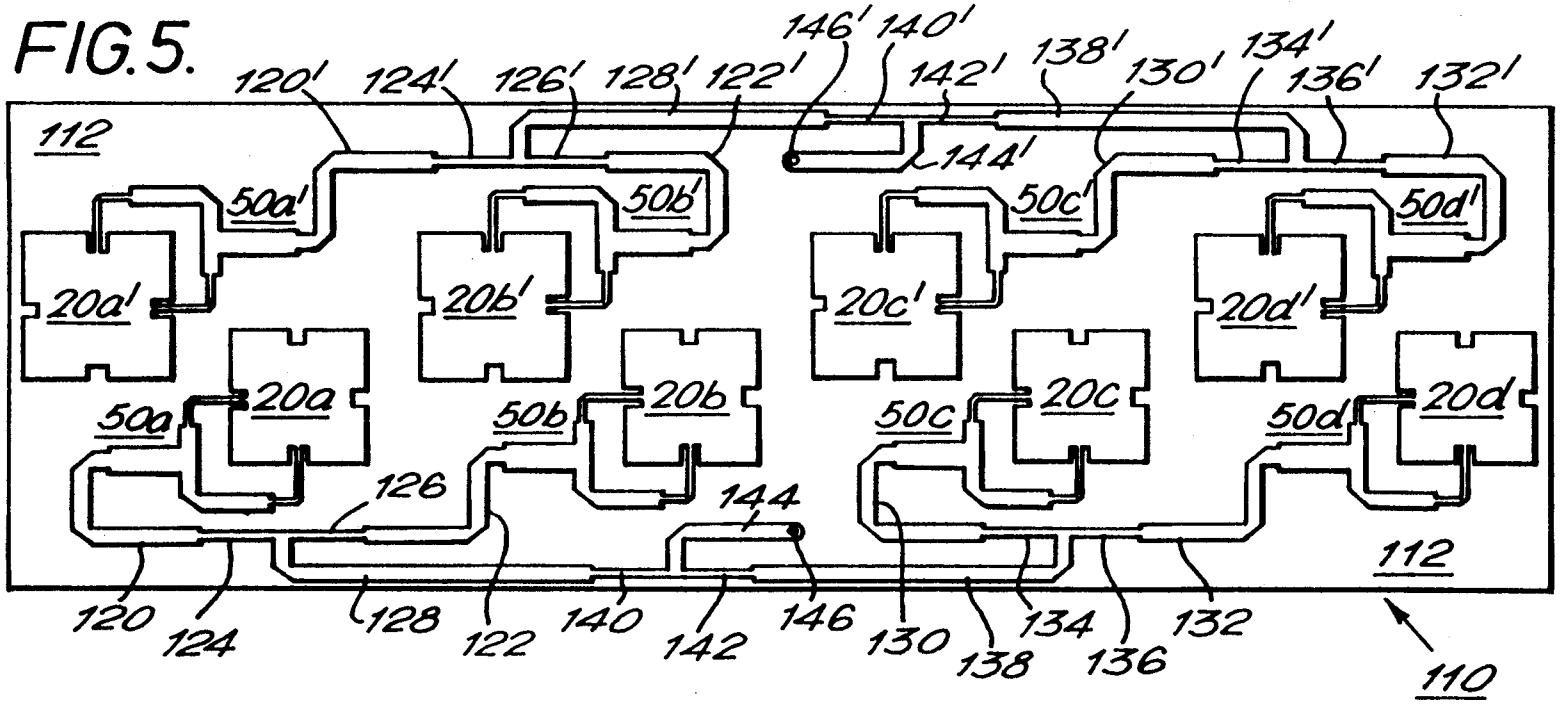
FIGS. 5 and 6 are an antenna array including a plurality of antenna elements including the present invention.

FIG. 5 is an antenna array comprised of a plurality of antenna elements of the sort described above in connection with FIG. 1. This array assembly 110 includes a plurality of antenna elements 20*a*, 20*b*, 20*c*, and 20*d* that form a transmit antenna array and a second plurality of antenna elements 20*a*', 20*b*', 20*c*', and 20*d*' that form a receive antenna array, all on dielectric substrate 112, side-by-side to each other. Each antenna element 20*a*, 20*b*, and so forth has a corresponding transmission line feed network 50*a*, 50*b*, and so forth, wherein the letter and the presence or absence of a prime (′), designate such networks corresponding to the antenna elements of like letter and priming. All of the foregoing antenna elements and feed networks are those as described above in relation to FIG. 1.

A further microstrip feed network comprising plural microstrip power combiner/splitters is employed to couple signals between connector holes 146 and 146' and the respective individual antenna element transmission networks 50*a* through 50*d* and 50*a*' through 50*d*'. These networks for the transmit portion of antenna array 110 receive at feed port (connector hole) 146 signals from a transmitter device. A 50-ohm transmission line 144 conducts those signals until they are split between two 100-ohm transmission lines 140 and 142, the operation of such splitting being the same as that described above in relation to elements 58, 62, and 72 of feed network 50 of FIG. 1 (except lines 140 and 142 are of equal length so that no phase differences are introduced). Conductor 140 transitions to a lower impedance 50-ohm conductor 128 which conducts signals further to two 100-ohm conductors 124 and 126 into which power is further split again so that one-fourth of the total power received at connector hole 146 goes to each of antenna elements 20*a* and 20*b* via feed networks 50*a* and 50*b* and 50-ohm conductors 120 and 122, respectively. In like fashion, the one-half of the transmitter signal on conductor 142 is coupled via 50-ohm conductor 138 to be split between two 100-ohm conductors 134 and 136 which respectively couple the signals via 50-ohm conductors 130 and 132 so that one-quarter of the signal received from the transmitter connector hole 146 is supplied to antenna elements 20*c* and 20*d* via feed networks 50*c* and 50*d*, respectively.

Unlike the microstrip transmission networks 50*a*–50*d* which include one path which is longer by an electrical length that is equivalent to a 90 degree phase shift at the operation frequency $f_0$, all of the legs within the microstrip feed network just described are symmetrical in length so that signals at substantially the same phase are received at each of the antenna element feed networks 50*a*–50*d*.

Corresponding microstrip power combiner/splitters are employed in the receive antenna array to couple the energy received at each of the four transmitter elements 20*a*'–20*d*' to the receiving device coupled to connector hole 146'. These power combiner/splitters work in like fashion to those described above in relation to the transmit antenna elements 20*a*–20*d*.

The signals are coupled to or from the drive points/-connector holes from the underside of the board as shown, for example, in Kaloi FIG. 1*b* using a connector or by a coaxial cable with its center conductor directly soldered to the antenna element and its shielding outer conductor soldered to the ground plane on the opposite side of the dielectric substrate.

Figure 6:
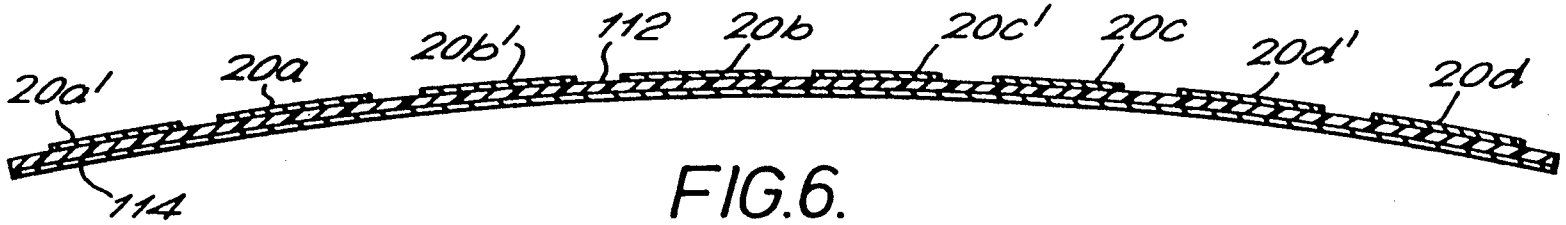

FIG. 6 is a cross-sectional view of the antenna array assembly 110 of FIG. 5 taken along the center line from left to right. Dielectric substrate 112 is curved so that it will conform to the object on which the antenna is to be mounted. Thus, the planar array 110 does not lie in a geometric plane in the strict sense, but as used herein is within the concept of a planar antenna array. In fact, the degree of curvature in antenna array 110 may be quite large, even to the point of encircling back on itself so that it is a cylindrical array. Antenna elements 20*a*, 20*a*', 20*b*, 20*b*' and so forth are on the circuit side or surface of dielectric substrate 112 while a continuous conductive ground plane 114 is on the ground plane side or surface thereof opposite the circuit side.

Figure 7:
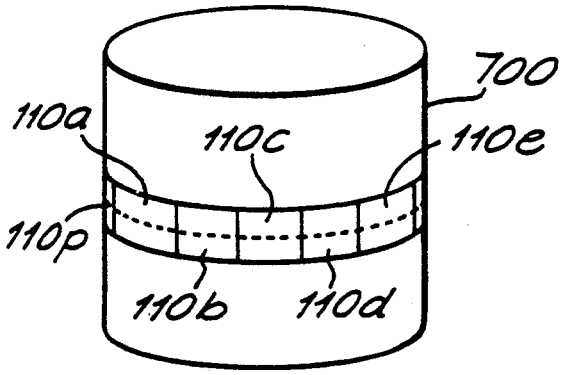
FIGS. 7 and 8 illustrate representative installations of the antenna array of FIG. 5.

FIG. 7 is an illustration of a cylindrical spacecraft 700 on which is mounted a circumferential band antenna array comprising a plurality of subarrays 110*a*, 110*b*, 110*c*, and so forth of the sort shown and described in relation to FIGS. 5 and 6 above. The dashed circumferential line indicates that each subarray includes a transmit section and a receive section side-by-side, also as described in connection with FIGS. 5 and 6. The circumferential array is comprised of 16 subarrays 110*a* through 110*p* each one having four transmit antenna patch elements and four receive antenna patch elements (making a total of 64 of each functional element for each of the transmit and receive arrays, which operate respectively at 2.265 GHz and 2.087 GHz.

Figure 8:
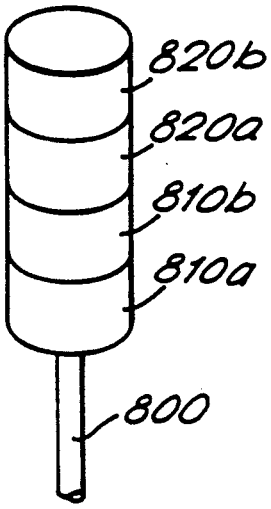

FIG. 8 is a further embodiment showing a plurality of antenna arrays similar to the sort described in connection with FIGS. 5 and 6 except that each array includes eight antenna patches that are either all transmitting or all receiving elements, and is bent 360 degrees so as to form the surface of a cylinder. Four arrays (transmit arrays 810*a* and 810*b* and receive arrays 820*a* and 820*b*) are stacked to form an elongated cylinder, the combined structure being mounted, for example, to a mast 800. The circumferential dashed line indicates that each of the subarrays 110*a*–110*d* has transmit antenna elements as well as a receive antenna elements. Thus, each of the transmit antenna arrays and receive antenna arrays is four antenna elements long by four antenna elements around the cylindrical surface.

Figure 9:
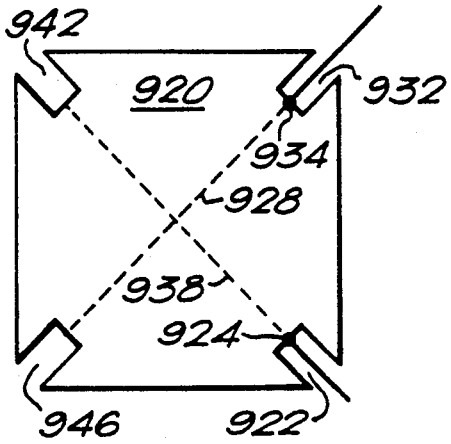
FIGS. 9, 10, 11, 12, and 13 are diagrams of antenna elements illustrating alternative embodiments including the present invention.

FIG. 9 illustrates another alternative embodiment for a single frequency dual linearly-polarized antenna element 920 which is geometrically symmetrical with respect to axes of symmetry 928 and 938. Antenna element 920 is the substantial equivalent of antenna element 20 of FIG. 1 with the notches and transmission line feeds rotated 45 degrees. Rectangular notches 922 and 942 are symmetrically disposed with respect to axis 928 and on opposite sides thereof, maintaining symmetry with respect to drive port 934. Similarly, rectangular notches 932 and 946 in element 920 are symmetrically disposed with respect to and on opposite sides of axis 938 maintaining symmetry with respect to feed point 924 at the base of notch 932. Element 920 may be operated as a single-frequency dual-polarized antenna if the same signals are applied at feed ports 924 and 934, or as a circularly polarized antenna if the signals at feed points 924 and 934 are in quadrature.

Figure 10:
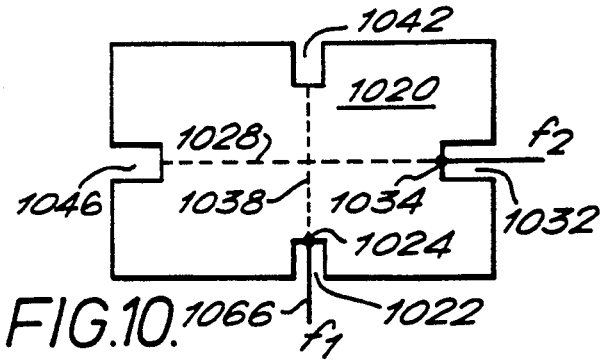

FIG. 10 is an alternative arrangement of a dual-frequency linearly-polarized antenna. Rectangular antenna element 1020 is geometrically symmetrical about both axes 1028 and 1038. Element 1020 has notches 1022 and 1032 which have drive points at their respective bases 1024 and 1034 at which signals at two different frequencies, a higher frequency $f_1$ and a lower frequency $f_2$, are coupled. Symmetrically disposed from notch 1022 with respect to axis 1028 and on the opposite side thereof is rectangular notch 1042. Similarly, symmetrically disposed from rectangular notch 1032 with respect to axis 1038 and on the opposite side thereof is rectangular notch 1046. The symmetry maintained thereby with respect to feed ports 1024 and 1034 improves the symmetry of the radiation pattern and reduces unwanted cross-polarization.

Figure 11:
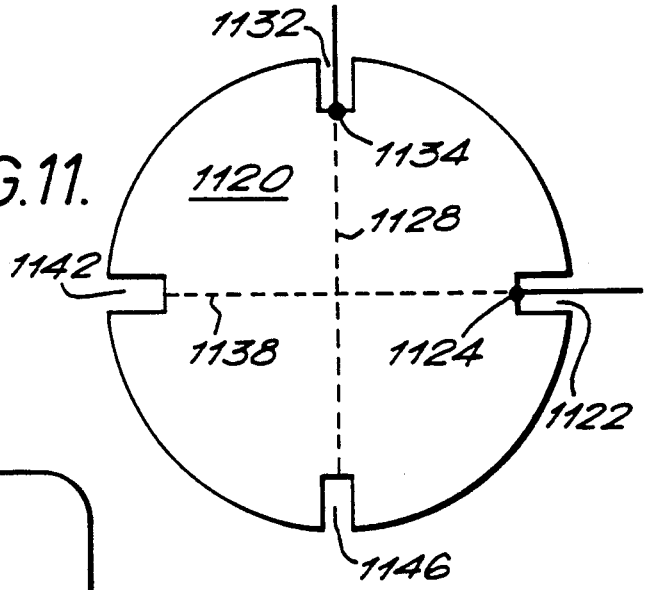

FIG. 11 is a further alternative embodiment where the geometrically symmetrical antenna element 1120 is circular and has rectangular notches 1122 and 1142 symmetrically disposed with respect to and on opposite sides of axis of symmetry 1128 and notches 1132 and 1146 likewise disposed with respect to axis 1138. Antenna element 1120 is the substantial equivalent of antenna element 20 of FIG. 1 and can be a single-frequency dual-polarized or circularly-polarized antenna depending on the relationship of the signals at ports 1224 and 1234.

Figure 12:
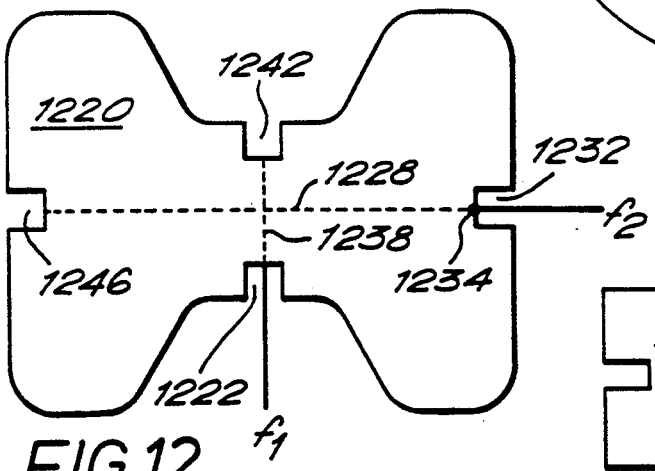

Further alternatives will be apparent to those of ordinary skill in the art. For example, in addition to the rectangular, square, and circular shapes of geometrically symmetrical antenna elements described herein, other geometrically symmetrical shapes such as ellipses, hexagons, octagons, and so forth may also be employed with the respective notches symmetrically disposed about an axis of symmetry thereof and on opposite sides of said axis even relatively free-form shapes may be employed, as illustrated by the element 1220 of FIG. 12, provided it has the requisite symmetry. It is further contemplated that antennas of any of the above-mentioned geometrically symmetrical shapes may have the notches located along edges thereof or at corners thereof, and may be configured in antenna arrays of the sort shown in FIG. 5, for example.

Figure 13:
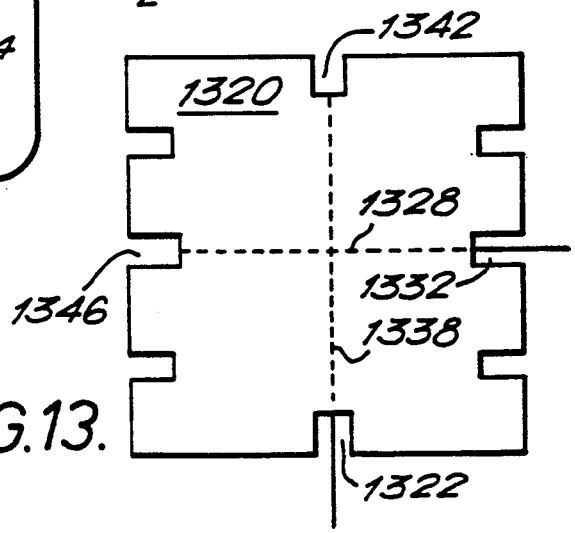

It is also contemplated that additional symmetrical notches, which provide a longer electrical effective length for a given patch size, may be symmetrically disposed in like manner to that described above, as shown for element 1320 of FIG. 13, for example. It is further contemplated that the notches need not be rectangular or of the same width, so long as effective electrical symmetry obtains, as illustrated between notches 1022 and 1042 on the one hand, and notches 1032 and 1046 on the other, of FIG. 10.

A key feature of the present invention is that symmetry is maintained about an axis of symmetry that is within the antenna element patch with respect to that drive point at which signals are coupled into or from the antenna and that the compensating notch disposed on the opposite side of that axis symmetry with respect to the notch that otherwise would cause asymmetry.

Further modifications and variations of antennas, and arrays thereof, including the present invention are contemplated to be within the scope of the present invention as set forth by the claims following, which should be broadly construed to encompass the full breadth and scope of the invention described herein.

What is claimed is:

1. An antenna comprising:

a substrate of a dielectric material;

a conductive ground plane on one surface of said dielectric substrate;

a planar element comprising a geometrically symmetrical area of a conductive material on an opposite surface of said dielectric substrate, said area having a periphery describing a shape having at least first and second axes of symmetry, wherein said second axis of symmetry intersects said first axis of symmetry within the area of said element and said first axis and said second axis are orthogonal, said element having a first notch in the periphery of said element on one side of said first axis and a second notch in the periphery thereof on the opposite side of said first axis, said first and second notches being rectangular and disposed along said second axis symmetrically with respect to said first axis, said element further having third and fourth notches in the periphery thereof, said third and fourth notches being rectangular and disposed along said first axis symmetrically with respect to said second axis;

first means coupling a first transmission line to said element at a location on an edge of said first notch remote from said periphery and on said second axis; and second means coupling a second transmission line to said element at a location on an edge of said third notch remote from said periphery and on said first axis.

2. The antenna of claim 1 wherein said first transmission line and said second transmission line both couple to a port, and wherein said first transmission line and said second transmission line have effective electrical lengths for providing at a predetermined frequency about 90 degrees of relative phase shift.

3. An antenna comprising:

a conductive ground plane;

a planar element of a conductive material separated from said ground plane by a dielectric medium, wherein the periphery of said element defines a geometrically symmetrical shape about first and second axes of symmetry, wherein said second axis of symmetry intersects said first axis of symmetry within the area of said element and said first axis and said second axis are orthogonal, said element having first and second rectangular notches in the periphery thereof symmetrically disposed with respect to both said first axis and said second axis of symmetry, said element further having third and fourth rectangular notches in the periphery thereof, said third and fourth notches being symmetrically disposed with respect to said first and second axes;

first means for coupling signals at a location on said element on an edge of said first notch remote from said periphery, said location being on one of said first and second axes; and second means for coupling signals at a location on said element on an edge of said third notch remote from said periphery, said location being on the other of said first and second axes.

4. The antenna of claim 3 wherein said first and second coupling means include a first transmission line and a second transmission line, respectively, both of which couple to a port, and wherein said first transmission line and said second transmission line have respective effective electrical lengths for providing at a predetermined frequency about 90 degrees of electrical phase shift.

5. An antenna comprising a plurality of the planar elements according to claim 3 arranged in predetermined positions on a surface; and further comprising a transmission line network for coupling the respective coupling means of each of said plurality of planar elements to a common node in predetermined relative electrical phase relationship.

6. The antenna array of claim 5 wherein the predetermined relative electrical phase relationships between signals at said common node and signals at each of the respective coupling means of each of said planar elements are substantially equivalent.

7. The antenna of claim 3 wherein said planar element comprises a conductive printed circuit pattern on a dielectric substrate.

8. A printed circuit antenna element comprising:

a dielectric substrate having a ground plane on one surface thereof;

a rectangular conductive pattern on the opposite surface of said substrate, and having four rectangular notches symmetrically disposed along the periphery thereof with respect to two orthogonal axes of symmetry of said rectangular conductive pattern; and first and second transmission lines on said opposite surface of said substrate and respectively connected to said pattern within first and second ones of said notches at ends opposite the open ends thereof and along respective ones of said axes of symmetry, said first and second notches being located adjacent each other along the periphery of said pattern.

9. The antenna element of claim 8 wherein said antenna element exhibits coupling between signals at said first and second notches, wherein the notch opposite said first notch has a width substantially the same as that of said first notch and has a depth for minimizing said coupling, and wherein the notch opposite said second notch has a width substantially the same as that of said second notch and has a depth for minimizing said coupling.

10. The antenna element of claim 8 wherein said first and second transmission lines couple first and second signals having different carrier frequencies from said antenna element when said antenna element is employed as a receiving element and to said antenna element when said antenna element is employed as a transmitting element.

11. The antenna element of claim 8 wherein said rectangular conductive pattern is a square and said first and second transmission lines couple first and second signals at substantially the same carrier frequency from said antenna element when said antenna element is employed as a receiving element and to said antenna element when said antenna element is employed as a transmitting element.

12. The antenna element of claim 8 wherein said rectangular conductive pattern is a square and said first and second transmission lines couple first and second signals at substantially the same carrier frequency from said antenna element when said antenna element is employed as a receiving element and to said antenna element when said antenna element is employed as a transmitting element, and wherein said first and second signals are substantially in quadrature phase relationship to each other.

13. An antenna comprising a plurality of the antenna elements according to claim 8 arrayed in predetermined positions on a surface, and a transmission line network disposed on said surface for coupling signals between a common node and the respective first and second transmission lines of each one of said plurality of antenna elements in predetermined phase relationship.

* * * * *